US006685577B1

(12) United States Patent
Scruggs et al.

(10) Patent No.: US 6,685,577 B1
(45) **Date of Patent: *Feb. 3, 2004**

(54) GOLF CLUB MADE OF A BULK-SOLIDIFYING AMORPHOUS METAL

(76) Inventors: David M. Scruggs, 5471 Loganberry Way, Oceanside, CA (US) 92057; William L. Johnson, 3546 Mountainview Ave., Pasadena, CA (US) 91107; Atakan Peker, 97 Fulmar La., Aliso Viejo, CA (US) 92656

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 577 days.

(21) Appl. No.: 08/963,131

(22) Filed: Oct. 28, 1997

Related U.S. Application Data

(63) Continuation of application No. 08/677,488, filed on Jul. 9, 1996, now abandoned, which is a continuation-in-part of application No. 08/566,885, filed on Dec. 4, 1995, now abandoned.

(51) Int. Cl.[7] ..... A63B 53/04
(52) U.S. Cl. ..... 473/349; 473/345
(58) Field of Search ..... 473/345, 346, 473/348–350, 324

(56) References Cited

U.S. PATENT DOCUMENTS

| | | | | |
|---|---|---|---|---|
| 4,699,383 A | | 10/1987 | Kobayashi | |
| 4,708,347 A | | 11/1987 | Kobayashi | |
| 4,754,975 A | | 7/1988 | Aizawa | |
| 5,024,437 A | | 6/1991 | Anderson | |
| 5,032,196 A | | 7/1991 | Masumoto et al. | |
| 5,074,935 A | | 12/1991 | Masumoto et al. | |
| 5,094,383 A | | 3/1992 | Anderson et al. | |
| 5,188,152 A | * | 2/1993 | Ogawa | 138/129 |
| 5,208,090 A | | 5/1993 | Okitsu et al. | |
| 5,226,652 A | | 7/1993 | Sato | |
| 5,255,918 A | | 10/1993 | Anderson et al. | |
| 5,261,663 A | | 11/1993 | Anderson et al. | |
| 5,261,664 A | | 11/1993 | Anderson | |
| 5,288,344 A | * | 2/1994 | Peker et al. | 148/403 |
| 5,344,140 A | | 9/1994 | Anderson | |
| 5,368,659 A | | 11/1994 | Peker et al. | |
| 5,417,419 A | * | 5/1995 | Anderson et al. | 473/345 |

FOREIGN PATENT DOCUMENTS

| | | |
|---|---|---|
| JP | 59-116059 | 8/1984 |
| JP | 59-133266 | 9/1984 |
| JP | 1-176467 | 12/1989 |
| JP | 4-336083 | 11/1992 |
| JP | 7-62502 | 3/1995 |
| WO | WO 94/23078 | 10/1994 |

OTHER PUBLICATIONS

Anon., "Physics in the material world", *The Economist*, Feb. 12, 1994, pp. 85–86.
Translation of the interview with John K. Thorne, *Golf Equipment Magazine*, Jun. 12, 1995.

(List continued on next page.)

*Primary Examiner*—Mark S. Graham
(74) *Attorney, Agent, or Firm*—Christie, Parker & Hale, LLP

(57) ABSTRACT

A golf club is made of a club shaft and a club head. Either the club shaft or the club head is made at least in part of a bulk-solidifying amorphous metal. A preferred bulk-solidifying amorphous metal has a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent. The weights of the various club heads of a set, which have different volumes, may be established by varying the compositions and thence the densities of the bulk-solidifying amorphous alloys.

21 Claims, 3 Drawing Sheets

OTHER PUBLICATIONS

A. Peker et al., "A highly processable metalllic glass: $Zr_{41.2}Ti_{13.6}Cu_{12.5}Be_{22.5}$," *Appl.Phys.Lett.*, vol. 63, No. 17 (Oct. 25, 1993).

Akihisi Inoue et al., "Production of Amorphous Cylinder and Sheet of $La_{55}Al_{25}Ni_{20}$ alloy by a Metallic Mold Casting Method," *Materials Transactions, JIM*, vol. 31, No. 5 (May 1990).

Tao Zhang et al., "Amorphous Zr–Al–TM (TM=Co,Ni,Cu) Alloys with Significant Supercooled Liquid Region of Over 100K", *Materials Transactions, JIM*, vol. 32, No. 11, Nov. 1991.

A. Inoue et al., "Mg–Cu–Y Bulk Amorphous Alloys with High Tensile Strength Produced by a High–Pressure Die Casting Method," *Materials Transactions, JIM*, vol. 33, No. 10 (Oct. 1992).

K.A. Bruck et al., "Quasi–Static Constitutive Behavior of $Zr_{41.25}Ti_{1.75}Ni_{10}Cu_{12.5}$ $Be_{12.5}$ Bulk Amorphous Alloys," *Scripta Metallurgica et Materialia*, vol. 30, pp. 429–434.

* cited by examiner

GOLF CLUB MADE OF A BULK-SOLIDIFYING AMORPHOUS METAL

BACKGROUND OF THE INVENTION

This application is a continuation of application Ser. No. 08/677,488 filed on Jul. 9, 1996, abandoned which is a continuation-in-part of application Ser. No. 08/566,885, filed Dec. 4, 1995 abandoned, for which priority is claimed.

This invention relates to golf clubs, and, more particularly, to the material of construction of the golf club shaft and the golf club head.

In the sport of golf, the golfer strikes a golf ball with a golf club. The golf club includes an elongated club shaft which is attached at one end to an enlarged club head and is wrapped at the other end with a gripping material to form a handle. The clubs are divided into several groups, depending upon the function of the club. These groups include the drivers, the irons (including wedges for the present purposes), and the putters.

Because golf has become a highly popular spectator and participant sport, a great deal of development effort has been devoted to golf clubs. Both the design of the clubs and the materials of construction have been improved in recent years. The present invention deals primarily with the materials of construction of golf clubs, and the following discussion will emphasize that subject area.

Until recent years, both the club shaft and the club head have been made primarily of metals such as steel and/or aluminum alloys. Composite-material shafts made of graphite-fiber-reinforced polymeric materials have been introduced, to reduce the weight and increase the material stiffness of the shaft. Heads made of specialty materials such as titanium alloys have been developed, to achieve reduced club head mass and density with high material stiffness so that the club head speed may be increased. The use of such materials also permits the manufacture of a larger-sized club head with the same mass or with redistributed weight and better performance. This brief discussion of new materials used in golf club shafts and heads is by no means exhaustive, and many other materials have been tried in order to achieve particular club behavior based upon various theories of club performance.

There remains a need, however, for further improvements in golf clubs in order to attain high material stiffness, high stiffness-to-weight ratio, and high strength-to-weight ratio. These properties, in turn, lead to higher club head speed and a higher degree of energy transfer from the club to the ball upon impact, thereby permitting any player to perform to the best of his or her ability without being limited by the nature of the golf clubs. The present invention fulfills this need, and further provides related advantages.

SUMMARY OF THE INVENTION

The present invention provides a golf club with an improved material of construction. The golf club exploits the unusual elastic properties of the material to provide a high degree of energy transfer from the club to the ball upon impact. The club is also corrosion resistant, wear resistant, and has a low coefficient of club head face friction. The club shaft and head are readily fabricated. For some clubs, the material of construction permits the configuration of the golf club to be modified so as to improve its performance.

In accordance with the invention, a golf club comprises a club shaft and a club head. Either or both of the club shaft and the club head are made at least in part of a bulk-solidifying amorphous metal. If the club shaft is made at least in part of a bulk-solidifying amorphous metal, the entire shaft is desirably made of the bulk-solidifying amorphous material. If the club head is made at least in part of the bulk-solidifying amorphous metal, at least the club head face is made of the bulk-solidifying amorphous material. The club head face may be made thinner and lighter when it is made of the bulk solidifying amorphous metal than when it is made of conventional metals, allowing a desirable redistribution of the weight of the club head toward the periphery of the club head.

A preferred composition for the bulk-solidifying amorphous metal is, in atom percent, from about 45 to about 67 percent total of zirconium plus titanium, from about 10 to about 35 percent beryllium, and from about 10 to about 38 percent total of copper plus nickel, plus incidental impurities, the total of the percentages being 100 atomic percent. Other bulk-solidifying amorphous metals may also be used.

Manufacture of a portion of the golf club from a bulk-solidifying amorphous metal yields surprising and unexpected improvements in club performance. If the club shaft is made of the bulk-solidifying amorphous metal, it is stiff and strong. If the club head is made of the bulk-solidifying amorphous metal, it is stiff, strong, and hard, thereby resisting damage resulting from impact of the club head with the golf ball. In both components, the amorphous metal sustains very high levels of elastic deformation with essentially no plastic deformation. It has been demonstrated that elastic tensile strains of up to about 2 percent are achieved with essentially no anelastic or plastic response of the material. Accordingly, the large elastic strains sustained during impact of the club head with the ball are accompanied by essentially no anelastic or plastic response. Consequently, virtually no energy is absorbed during the deformation of the club head during impact with the golf ball. A higher fraction of the energy of the golfer's swing is therefore transferred into the golf ball upon impact than in the case of the use of a material which exhibits a significant degree of absorption of energy by anelastic or plastic deformation.

The approach of the present invention also permits the weights of the different club heads in a club set to be varied independently of the volume of the club head or in conjunction with the volume of the club head in an arbitrary manner. The shapes and volumes of different club heads in a set vary. By custom and tradition, club weights increase from a 2-iron to a sand wedge. In the conventional approach, optimal design deals with the shape (i.e., volume) of the club head. The weights of the individual clubs cannot be varied outside of limits established either by professional standards or established user preferences. When conventional materials are used to make the club heads, the weights of the club heads vary directly proportionally to the volume of the club head.

According to the present invention, a set of golf clubs comprises a first club having a first club head with a first volume and made of a first bulk-solidifying amorphous alloy having a first composition and a first density. The set further comprises a second club having a second club head with a second volume and made of a second bulk-solidifying amorphous alloy having a second composition different from the first composition and a second density different from the first density. The first and second bulk-solidifying amorphous alloys are preferably selected from the same alloy family, i.e., alloys whose compositions are within the same continuous range.

The compositions and densities within a bulk-solidifying amorphous alloy system may be varied in small increments but over a wide range, permitting the weights of the club heads to be arbitrarily determined by composition selection within a wide range. An example is useful in illustrating this point. If it were desired that the club heads of two different clubs should have the same weight, a first product of the first volume times the first density, the weight of the first club head, is made about the same as a second product of the second volume times the second density, the weight of the second club head. That is, for this constant-weight situation the compositions of the alloys used to make the club heads are selected so as to vary their densities inversely with the volume of the club heads for which they are to be used. Known bulk-solidifying amorphous alloy families permit such density variation within the range of feasible club head design variations. The same principles are applied for the other clubs in the set. The golfer thus has a club set where the heads are of substantially constant weight, while also enjoying the other advantages of the bulk-solidifying amorphous alloys.

The constant-weight example is just one case of the ability provided by the present invention to arbitrarily vary the club-head weights independently of the club-head volume. The weights of the club heads of the set may instead be made to vary in some other fashion, independently of the club volume. This capability permits the club designer wide latitude in selecting club-head shapes and weights. The wide range of weights and tailoring of the weights are achieved with a homogeneous alloy material, and without the use of cumbersome weights, plugs, or other inserts that alter the impact and mass-distribution properties of the club head.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 3A–3C are three enlarged sectional views of three embodiments of the club head, taken along lines 3—3 of FIG. 1, wherein FIG. 3A depicts a putter club head, FIG. 3B depicts an iron club head, and FIG. 3C depicts a driver club head;

DETAILED DESCRIPTION OF THE INVENTION

Figure 1:
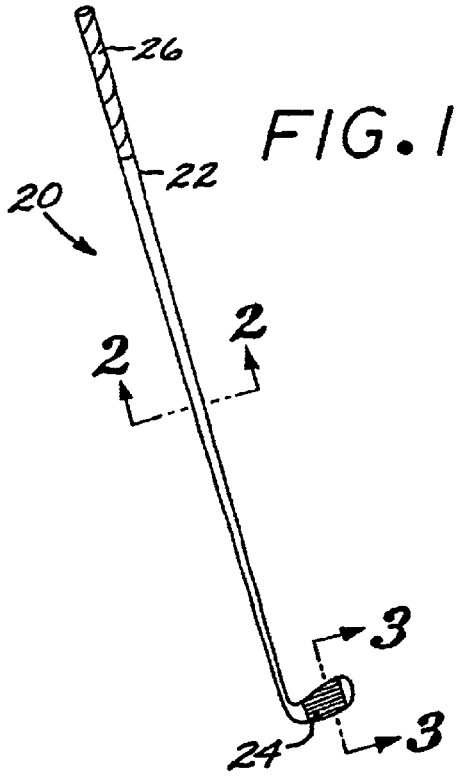
FIG. 1 is a perspective view of a golf club.
Figure 2:
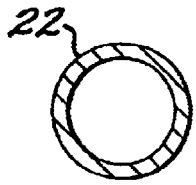
FIG. 2 is an enlarged sectional view of the club shaft, taken along lines 2—2 of FIG. 1.

FIG. 1 depicts a golf club 20. The golf club 20 includes a club shaft 22 and a club head 24 attached to a lower end of the club shaft 22. A handle 26 is formed at an upper end of the club shaft 22 by wrapping a gripping material around the club shaft 22. FIGS. 1–3, showing embodiments of the club, club shaft, and club head, are somewhat schematic in form and are intended to generally portray these elements. There are many variations of the basic design configuration of the golf club, and the present invention dealing with materials of construction is applicable to all of these variations.

The club shaft 22 is elongated and generally rodlike in form. The club shaft may be solid in cross section, or it may be hollow as shown in FIG. 2. The club shaft is preferably hollow in cross section in the present invention.

Figure 3A:
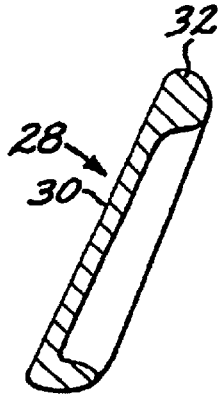
Figure 3B:
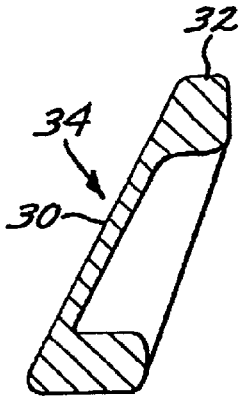
Figure 3C:
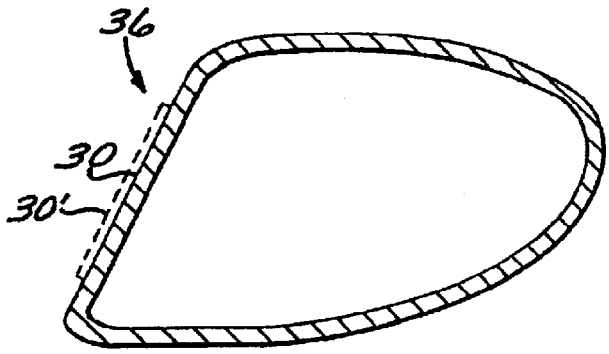

The club head 24 has many design variations, but they may be generally classified into three groups as shown in FIG. 3. A putter club head 28 (FIG. 3A) has a club head face 30 with bolsters 32 at the ends. The club head face 30 is usually roughly vertical to the ground when the golf club is held by the user. An iron club head 34 (as used herein, irons include wedges), shown in FIG. 3B, has a similar construction, with a number of different angles of the club head face 30 to the ground available to aid the golfer to determine the loft of the shot. (The word "iron" is here a term of art for the type of club, and does not suggest that the club head is made of the metal iron.) A driver club head 36 may have the basic form of the putter head, but more preferably has a more massive, rounded body shape such as shown in FIG. 3C. As with the iron club head, the angle of the club head face 30 to the ground of the driver club head varies with different types of drivers. The club head face 30 may be integral with the body of the club head. The club head face 30 may include a separate plate 30' that is fabricated separately and joined to the body of the club head, as shown in dashed lines in FIG. 3C.

Either the club shaft 22 or the club head 24 is made at least in part of a bulk-solidifying amorphous alloy, preferably by casting the alloy to shape in a properly configured mold. Bulk-solidifying amorphous alloys are a recently developed class of amorphous alloys that retain their amorphous structures when cooled from high temperatures at critical cooling rates of about 500° C. or less, depending upon the alloy composition. Bulk-solidifying amorphous alloys have been described, for example, in U.S. Pat. Nos. 5,288,344, 5,368,659, and 5,032,196, whose disclosures are incorporated by reference.

Figure 7:
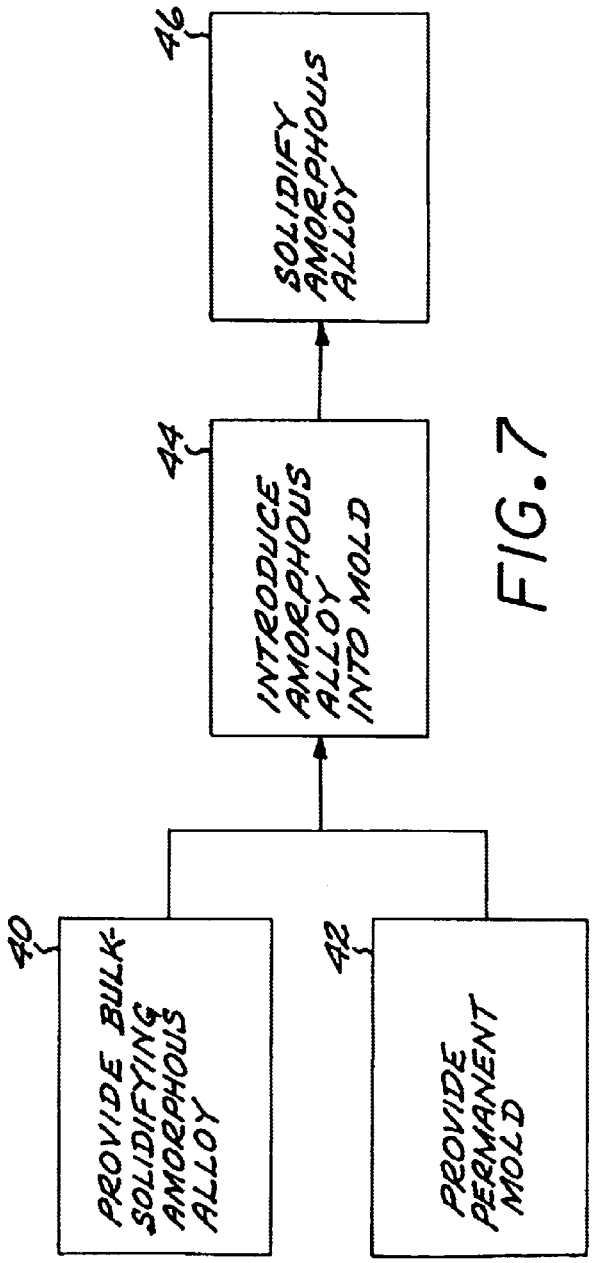
FIG. 7 is a block flow diagram of an approach for preparing a cast golf club component.

The golf club component made of the bulk-solidifying amorphous alloy is preferably made by "permanent mold casting", which, as used herein, includes die casting or any other casting technique having a permanent mold into which metal is introduced, as by pouring, injecting, vacuum drawing, or the like. Referring to FIG. 7, a bulk-solidifying amorphous alloy, to be described in greater detail subsequently, is provided, numeral 40. A permanent mold having a mold cavity defining the shape of the golf club component, such as the golf club head, is provided, numeral 42. The bulk-solidifying amorphous alloy is heated to a temperature such that it may be introduced into the permanent mold, numeral 44. The bulk-solidifying amorphous alloy is cooled to relatively low temperature, such as room temperature, at a rate sufficiently high that the amorphous structure is retained in the final cast product, numeral 46.

This approach is to be contrasted with the processing used with conventional materials. Golf club heads made of conventional high strength materials such as titanium and steel are investment cast by the lost wax process or forged to shape. Both techniques require finishing operations such as machining and grinding. The investment casting process provides moderately low-cost products that are not technologically the equal of forged products, whereas forging provides higher quality products at a substantially higher cost. The quality of forged products is due to the higher strength of forged metals, more uniform and porosity-free structure, and better control of dimensions such as wall thicknesses than possible with investment casting. Investment cast products such as golf-club heads have lower strengths due to porosity, and they exhibit shrinkage in the casting operations. A different mold is created from a wax pattern for each golf-club head that is to be investment cast. Consequently, the dimensions of the golf club head, such as its wall thickness, cannot be consistently reproduced due to movement of the wax pattern and other factors. The resulting article may therefore vary significantly from the design. The variations are such that some golf-club heads produced within the relatively wide tolerances of the investment casting process may not be within the relatively narrow tolerances of the club design, and accordingly must be scrapped. The tolerances of forging operations are narrower, but forging is considerably more costly than investment casting and typically requires some machining of the product.

The golf-club components made by permanent-mold casting of bulk-solidifying amorphous alloys overcome the shortcomings of the prior approaches by achieving good tolerances with much lower cost than possible with either investment cast or forged golf club heads. The golf-club component closely matches the design. The bulk-solidifying components made by permanent-mold casting have low or negligible shrinkage and porosity, leading to good strength and also to low variation in shape. They also exhibit excellent surface finish and replication of the mold interior. There are no spurious features due to the wax patterns sometimes found in investment cast articles or due to the forging defects sometimes found in forged articles. Only a single permanent mold is used, or a group of permanent molds are used which are carefully matched to each other because they are repeatedly used. In each case, the permanent mold or molds are carefully matched to the club design. The permanent mold casting of crystalline alloys such as titanium alloys and steels, used in conventional golf club heads, is not economically practical because of the higher mold wear experienced with these alloys, which have higher casting temperatures than known bulk-solidifying amorphous alloys. The solidification shrinkage and consequent warping of these conventional crystalline alloys also does not permit the net-shape casting possible with the bulk-solidifying amorphous alloys.

Bulk-solidifying amorphous metal alloys may be cooled from the melt at relatively low cooling rates, on the order of 500° C. per second or less, yet retain an amorphous structure. Such metals do not experience a liquid/solid crystallization transformation upon cooling, as with conventional metals. Instead, the highly fluid, non-crystalline form of the metal found at high temperatures becomes more viscous as the temperature is reduced, eventually taking on the outward physical appearance and characteristics of a conventional solid. Even though there is no liquid/solid crystallization transformation for such a metal, an effective "freezing temperature", $T_g$ (often referred to as the glass transition temperature), may be defined as the temperature below which the viscosity of the cooled liquid rises above $10^{13}$ poise. At temperatures below $T_g$, the material is for all practical purposes a solid. An effective "fluid temperature", $T_f$, may be defined as the temperature above which the viscosity falls below $10^2$ poise. At temperatures above $T_g$, the material is for all practical purposes a liquid. At temperatures between $T_f$ and $T_g$, the viscosity of the bulk-solidifying amorphous metal changes slowly and smoothly with temperature. For the zirconium-titanium-nickel-copper-beryllium alloy of the preferred embodiment, $T_g$ is about 350–400° C. and $T_f$ is about 700–800° C.

This ability to retain an amorphous structure even with a relatively slow cooling rate is to be contrasted with the behavior of other types of amorphous metals that require cooling rates of at least about $10^4$–$10^{6}$° C. per second from the melt to retain the amorphous structure upon cooling. Such metals may only be fabricated in amorphous form as thin ribbons or particles. Such a metal has limited usefulness because it cannot be prepared in the thicker sections required for typical articles of the type prepared by more conventional casting techniques, and it certainly cannot be used to prepare three-dimensional articles such as golf club shafts and heads.

A preferred type of bulk-solidifying amorphous alloy has a composition of about that of a deep eutectic composition. Such a deep eutectic composition has a relatively low melting point and a steep liquidus. The composition of the bulk-solidifying amorphous alloy should therefore preferably be selected such that the liquidus temperature of the amorphous alloy is no more than about 50–75° C. higher than the eutectic temperature, so as not to lose the advantages of the low eutectic melting point.

A most preferred type of bulk-solidifying amorphous alloy family has a composition near a eutectic composition, such as a deep eutectic composition with a eutectic temperature on the order of 660° C. This material has a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent. A substantial amount of hafnium may be substituted for some of the zirconium and titanium, aluminum may be substituted for the beryllium in an amount up to about half of the beryllium present, and up to a few percent of iron, chromium, molybdenum, or cobalt may be substituted for some of the copper and nickel. This bulk-solidifying alloy is known and is described in U.S. Pat. No. 5,288,344. A most preferred such metal alloy material, termed Vitreloy™-1, has a composition, in atomic percent, of about 41.2 percent zirconium, 13.8 percent titanium, 10 percent nickel, 12.5 percent copper, and 22.5 percent beryllium.

Another such metal alloy family material has a composition, in atom percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent. A most preferred metal alloy of this group has a composition, in atomic percent, of about 60 percent zirconium about 15 percent aluminum, and about 25 percent nickel. This alloy system is less preferred than that described in the preceding paragraph, because of its aluminum content. Other bulk-solidifying alloy families, such as those having even high contents of aluminum and magnesium, are operable but even less preferred.

Figure 4:
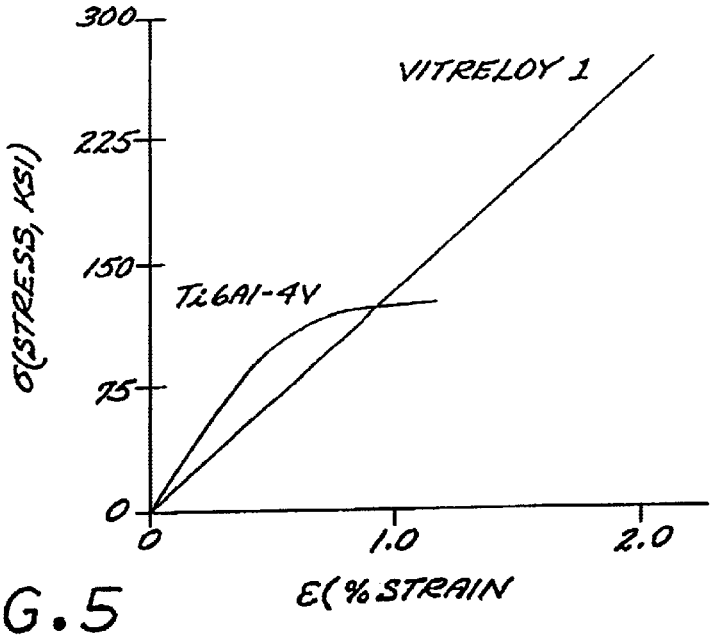
FIG. 4 are measured stress-strain curves for a titanium alloy and for a bulk-solidifying amorphous alloy.

The use of bulk-solidifying amorphous alloys in golf club shafts and/or club heads offers some surprising and unexpected advantages over conventional metals, metallic composites, and nonmetallic composites used as materials of construction. The bulk-solidifying amorphous alloys exhibit a large fully-elastic deformation without any yielding, as shown in FIG. 4 for the case of Vitreloy™-1. This bulk-solidifying amorphous alloy strains 2 percent and to a stress of about 270 ksi (thousands of pounds per square inch) without yielding, which is quite remarkable for a bulk material. The energy stored when the material is stressed to the yield point, sometimes termed $U_d$, is 2.7 ksi. By comparison, a current titanium alloy popular in some advanced golf club shafts and heads yields at a strain of about 0.65 percent and a stress of about 110 ksi, with a stored energy $U_d$ to the yield point of about 0.35 ksi. The best prior material for energy storage, a copper-beryllium alloy, has a $U_d$ of about 1.15 ksi, less than half that of the preferred bulk-solidifying amorphous alloy.

Another important material property affecting the performance of the club head is the energy dissipation in the club head as the ball is hit. Many metallic alloys experience microyielding in grains oriented for plastic microslip, even at applied stresses and strains below the yield point. For many applications the microyielding is not an important consideration. However, when the material is used in a club head face where there is a large impact force at the moment the club head hits the golf ball, the microyielding absorbs and dissipates energy that otherwise would be transferred to the ball.

Figure 5:
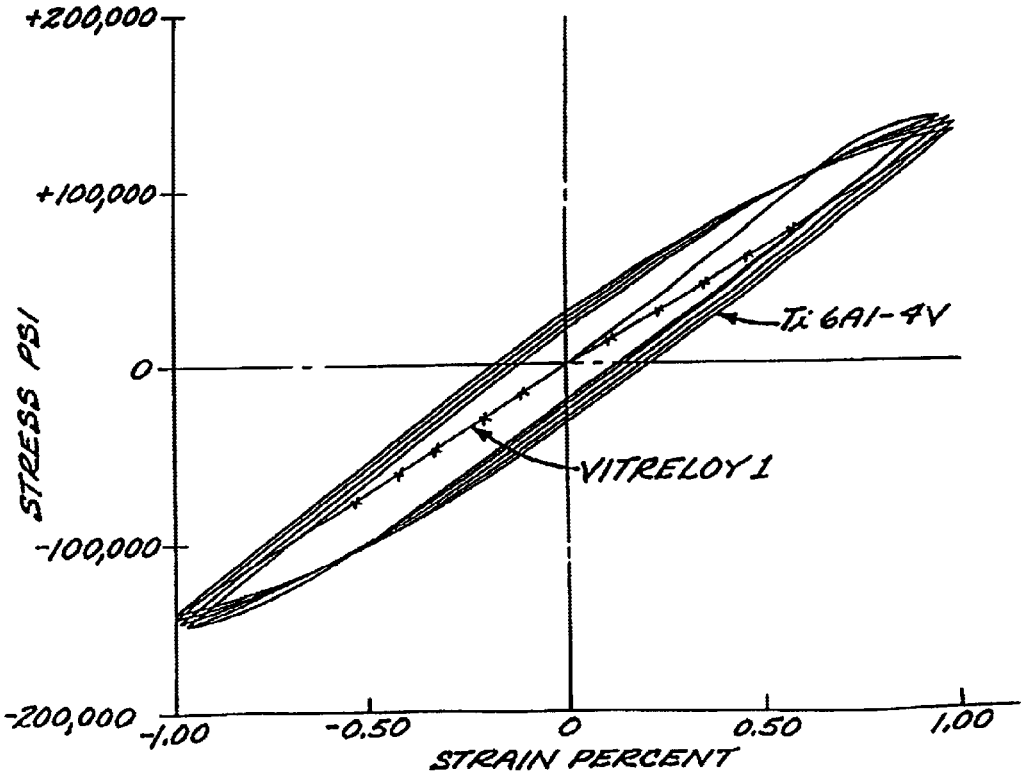
FIG. 5 is a measured graph of stress versus strain for a titanium alloy and for the preferred bulk-solidifying amorphous alloy (Vitreloy™-1) during cyclic straining of the materials.

FIG. 5 illustrates the deformation behavior of aircraft quality, forged and heat-treated titanium-6 weight percent aluminum-4 weight percent vanadium (Ti-6Al-4V), a known material for use in golf-club heads, as compared with that of the Vitreloy™-1 alloy, when strained to a level approximately indicative of local strains experienced by the club head face of a driver during impact with the golf ball. Yielding is evidenced by a hysteresis in the cyclic stress-strain curve upon repeated loading and reverse loading, even when the loading is below the macroscopic yield point (a phenomenon termed "microyielding"). The Ti-6Al-4V exhibits extensive hysteresis resulting from the yielding and microyielding. The Vitreloy™-1 bulk-solidifying amorphous alloy exhibits no hysteresis upon repeated loading and reverse loading. The absence of hysteresis in the loading behavior of the Vitreloy™-1 alloy results from the amorphous microstructure of the material wherein there are no grains or other internal structures which exhibit microplastic deformation and consequently microyielding during loading and reverse loading. This difference in behavior of conventional polycrystalline club head alloys and the amorphous alloys is further verified by improved performance in bounce tests wherein a metal ball is dropped onto the surface of the material. The bounce is significantly higher for the amorphous alloys than for the polycrystalline alloys, indicating less (and in fact, substantially no) energy absorption for the amorphous alloys and significant energy absorption for the polycrystalline alloys.

The desirable deformation behavior of the material of the club made according to the invention may be characterized as an elastic strain limit of at least about 1.5 percent, preferably greater than about 1.8 percent, and most preferably about 2.0 percent, with an accompanying plastic strain of less than about 0.01 percent, preferably less than about 0.001 percent up to the elastic strain limit. That is, the material exhibits substantially no plastic deformation when loaded to about 80 percent of its fracture strength.

The bulk-solidifying amorphous alloys have excellent corrosion resistance due to the absence of grain boundaries. They have as-cast surfaces that are very smooth, when cast against a smooth surface, and have low coefficients of friction. The smooth surface is attractive in appearance, and the low coefficients of friction reduce the bite on the ball which would tend to cause it to follow a hook or slice trajectory. The amorphous alloys may be readily cast as club shafts or heads using a number of techniques, most preferably permanent mold casting, permitting fabrication of the components at reasonable cost.

The preferred alloys used in the golf club have an exceedingly high strength-to-density ratio, on the order of twice that of metals currently used in golf club heads such as steel and Ti-6Al-4V alloy. This property of the materials may be characterized as a strength-to-density ratio of at least about $1\times10^6$ inches, and preferably greater than about $1.2\times10^6$ inches. This feature, together with the high elastic limit (FIG. 4) of the amorphous material and its low damping properties (FIG. 5), permits a surprising and unexpected redesign of the golf club head to achieve improved performance.

For example, the club head face (30 and/or 30') of the club head, which is near the point of impact of the ball, may be reduced in thickness, so that its mass may be redistributed to the periphery of the club head face and the club head. This redesign in turn gives the golf club head a greater moment of inertia about the point of impact, which leads to a greater stability against unwanted twisting motions of the club head. The redesign is accomplished without changing the overall mass of the club head. A club head face made with conventional steel or titanium materials is typically about 3 millimeters or more thick, so that it does not plastically buckle upon ball impact. A club head face made of the amorphous material of the invention may be made less than 2.5 millimeters thick, and most preferably in the range of from about 1.5 to about 2 millimeters thick. If it is less thick, there is a risk of plastic buckling upon impact. If it is thicker, the advantages discussed herein are lost. The thin club head face results in a "soft" feel to the club when a ball is impacted. The mass saved as a result of the reduction in thickness of the club head face may be redistributed to the periphery of the club head face or elsewhere at the periphery of the club, thereby providing the increased moment of inertia and greater stability discussed previously.

Figure 6B:
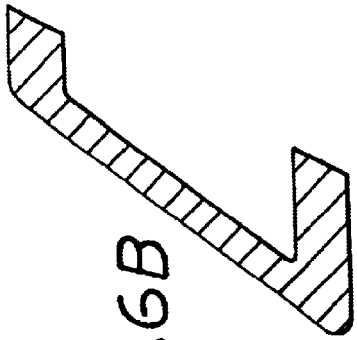
FIG. 6B is a side sectional view of a second iron club head having a second volume.
Figure 6A:
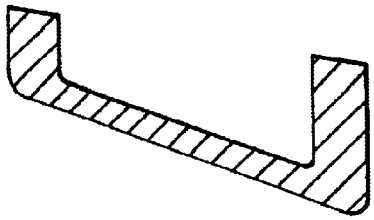
FIG. 6A is a side sectional view of a first iron club head having a first volume.

FIGS. 6A and 6B depict a particularly desirable application of the invention to a set of golf clubs. Within a set of clubs having drivers, irons, and a putter, the volumes of the club heads may vary considerably. For example, a typical 3-iron illustrated in FIG. 6A has a volume of about 31.2 cubic centimeters (cc), and a typical 8-iron illustrated in FIG. 6B has a volume of about 35.6 cc. The shapes of the club heads and thence their volumes are determined primarily by specifications established by the professional golfing associations. There is a trend, however, to the use of larger irons. When the two club heads are made of the same material, such as a conventional metal alloy, the weight of each club head varies proportionally to its volume.

The density properties of bulk-solidifying amorphous alloys offer two important advantages to the design of golf-club heads, not available with other candidate materials. The first is the absolute value of the density range of the materials, and the second is the ability to vary the density over a wide range while maintaining other pertinent mechanical and physical properties within acceptable ranges. As to the absolute value of the density range, the densities of the preferred bulk-solidifying amorphous alloys are from about 5.0 grams per cc to about 7.0 grams per cc. These densities may be compared with the densities of conventional candidate golf-club head materials such as copper-beryllium, density 8.0 grams per cc; steel, density 7.8 grams per cc; titanium, density 4.5 grams per cc; and aluminum, density 2.7 grams per cc. The densities of these conventional materials are relatively constant and cannot be readily varied. There is a large gap in density between copper-beryllium and steel, at the upper end, and titanium. The present alloys lie in this gap region of density. Their use permits, for example, an iron to have a larger size and volume than a steel iron, but to have about the same weight.

The second significant virtue of the use of amorphous alloys to manufacture the club heads is that their densities may be selectively varied over a moderately wide range of values. For example, within the broad composition range of the preferred alloy (having a composition, in atom percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent), the densities may be varied from about 5.0 grams per cc to about 7 grams per cc by changing the compositions while staying in the permitted range that results in a bulk-solidifying amorphous alloy.

A range of particular interest to the inventors is from about 5.7 grams per cc to about 6.2 grams per cc. Compositions of the bulk-solidifying amorphous alloys within the preferred range that yield densities within the range of particular interest are shown in the following table:

| | Composition (atomic %) | | | | |
|---|---|---|---|---|---|
| Density | Zr | Cu | Ti | Ni | Be |
| 6.2 | 44.4 | 13.5 | 10.9 | 10.4 | 20.8 |
| 6.0 | 37.3 | 9.7 | 18.9 | 9.3 | 24.8 |
| 5.9 | 35.6 | 8.9 | 20.3 | 9.3 | 25.9 |
| 5.7 | 29.6 | 8.3 | 27.7 | 8.1 | 26.3 |

This ability to vary the density of the metal is used to advantage by selecting the composition of the bulk-solidifying amorphous alloy so that its density times the volume of the club head, the total weight of the club head, meets a design value established by the club designer. The present inventors are not golf-club head designers, and the following examples are prepared for illustration purposes only. If a first club head (e.g., a 2-iron) has a design volume of about 39.3 cc and a second club head (e.g., an 8-iron) has a design volume of about 42.7 cc, to maintain the two club heads of approximately constant weight of 244 grams, the first club head may be made of the bulk-solidifying amorphous alloy having a density of 6.2 grams per cc and the second club head may be made of the bulk-solidifying amorphous alloy having a density of about 5.7 grams per cc. The preceding table gives compositions suitable for achieving these densities. Because the compositions of both alloys are selected within the permissible range of the bulk-forming amorphous alloys, the club heads will both be amorphous and will be of about the same total weight (the product of density of the material times the volume of the club head) and of comparable materials properties such as discussed previously. These principles are directly extended to multiple clubs of the set having heads of different volumes.

In other cases, the club-head designer may not wish to achieve constant weights, but instead to have the weights vary in some selected fashion. To continue with the prior example, if the 2-iron having a volume of 39.3 cc is made of the bulk-solidifying amorphous alloy having a density of 5.7 grams, its weight would be 224 grams, a more suitable weight for persons of smaller stature. If the 8-iron of volume 42.7 cc is made of the bulk-solidifying amorphous alloy having a density of 6.2 grams, its weight would be 265 grams, a weight more suitable for persons of larger stature. In all cases, the club heads are made of the amorphous alloys with their superior properties, and which may be cast using the same 2-iron and 8-iron molds by permanent-mold casting. In the example, this range of properties is achieved using only variations of the densities from 5.7 to 6.2 grams per cc. The compositions of alloys within the preferred bulk-solidifying amorphous alloy family permits significantly wider variations of about 5.0 to about 7.0 grams per cc, so that even wider variations in weights are possible.

From these illustrative examples, it is apparent that the golf-club designer has available an important new approach by which golf clubs may be designed both as to their physical configuration and size (and thence volume) and an independently selected material density. The selection of these characteristics permits the golf clubs to be tailored to individual performance and characteristics of golfers.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A golf club head made at least in part of a bulk-solidifying amorphous metal that may be cooled from the melt at a cooling rate of about 500° C. per second or less, yet retain an amorphous structure, the golf club head being fabricated by casting the bulk-solidifying amorphous metal to shape in a mold.

2. The golf club head of claim 1, wherein the golf club head is a driver club head.

3. The golf club head of claim 1, wherein the golf club head is an iron club head.

4. The golf club head of claim 1, wherein the golf club head is a putter club head.

5. The golf club head of claim 1, wherein the club head has a club head face made of a bulk-solidifying amorphous metal.

6. The golf club head of claim 5, wherein the club head face has a thickness of less than about 2.5 millimeters.

7. The golf club head of claim 5, wherein the club head face has a thickness of from about 1.5 to about 2.0 millimeters.

8. The golf club head of claim 1, wherein the bulk-solidifying amorphous metal has a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

9. The golf club head of claim 1, wherein the bulk-solidifying amorphous metal has a composition, in atomic percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent.

10. The golf club head of claim 1, wherein the bulk-solidifying amorphous alloy exhibits substantially no plastic deformation when loaded to about 80 percent of its fracture strength.

11. The golf club head of claim 1, wherein the bulk-solidifying amorphous alloy has an elastic strain limit of at least about 1.5 percent strain.

12. The golf club head of claim 1, wherein the bulk-solidifying amorphous alloy has a strength-to-density ratio of at least about $1\times10^6$ inches.

13. The golf club head of claim 1, wherein the amorphous metal has a strength-to-density ratio of at least about $1\times10^6$ inches, an elastic strain limit of more than about 1.5 percent, and a density of from about 5.0 to about 7.0 grams per cubic centimeter.

14. A golf club head, wherein at least part of the club head is made of a bulk-solidifying amorphous metal that may be cooled from the melt at a cooling rate of about 500° C. per second or less, yet retain an amorphous structure, and wherein the golf club head is fabricated by casting the bulk-solidifying amorphous metal to shape in a properly shaped permanent mold.

15. The golf club head of claim 14, wherein the bulk-solidifying amorphous metal has a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

16. The golf club head of claim 14, wherein the bulk-solidifying amorphous metal has a composition, in atomic percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent.

17. A driver golf club head, wherein at least part of the driver club head is made of a bulk-solidifying amorphous metal that may be cooled from the melt at a cooling rate of about 500° C. per second or less, yet retain an amorphous structure, and wherein the golf club head is fabricated by casting the bulk-solidifying amorphous metal to shape in a properly shaped permanent mold.

18. The golf club head of claim 17, wherein the bulk-solidifying amorphous metal has a composition, in atomic percent, of from about 45 to about 67 percent total of zirconium plus titanium, from about 10 to about 35 percent beryllium, and from about 10 to about 38 percent total of copper plus nickel, plus incidental impurities, the total of the percentages being 100 atomic percent.

19. The golf club head of claim 17, wherein the bulk-solidifying amorphous metal has a composition, in atomic percent, of from about 25 to about 85 percent total of zirconium and hafnium, from about 5 to about 35 percent aluminum, and from about 5 to about 70 percent total of nickel, copper, iron, cobalt, and manganese, plus incidental impurities, the total of the percentages being 100 atomic percent.

20. A golf club head having at least a portion thereof cast to shape against a mold and made of a metal having a strength-to-density ratio of at least about $1\times10^6$ inches, an elastic strain limit of more than about 1.5 percent, and a density of from about 5.0 to about 7.0 grams per cubic centimeter.

21. The golf club head of claim 20, wherein the metal is a bulk-solidifying amorphous metal that may be cooled from the melt at a cooling rate of about 500° C. per second or less, yet retain an amorphous structure.

* * * * *